United States Patent [19]

Brow

[11] 4,300,747

[45] Nov. 17, 1981

[54] FLAT SHOE FORM TIE BRACKET FOR USE WITH CONCRETE FORMS

[76] Inventor: Arthur J. Brow, 3303 S. 40th St., Phoenix, Ariz. 85040

[21] Appl. No.: 205,673

[22] Filed: Nov. 10, 1980

[51] Int. Cl.[3] ..... E04G 17/06

[52] U.S. Cl. ..... 249/217; 249/218

[58] Field of Search ..... 249/217, 214, 213 R, 249/219 R

[56] References Cited

U.S. PATENT DOCUMENTS

| | | | |
|---|---|---|---|
| 1,857,610 | 5/1932 | Schenk | 249/214 |
| 2,168,990 | 8/1939 | Hungerford | 25/131 |
| 2,190,700 | 2/1940 | Colt | 25/131 |
| 2,245,559 | 6/1941 | Kinninger | 249/214 |
| 2,268,883 | 1/1942 | Lind | 249/214 |
| 3,069,743 | 12/1962 | Luyben | 25/131 |
| 3,074,141 | 1/1963 | Bowden et al. | 249/214 |
| 3,199,828 | 8/1965 | Newton | 249/46 |
| 3,315,937 | 4/1967 | Eriksson | 249/44 |
| 3,327,986 | 6/1967 | Oury | 249/45 |
| 3,362,678 | 1/1968 | Bowden | 249/214 |
| 3,734,453 | 5/1973 | Bailey | 249/213 |
| 3,907,244 | 9/1975 | Abbott | 249/40 |
| 3,926,400 | 12/1975 | Franc | 249/40 |
| 3,977,647 | 8/1976 | Williams | 249/191 |
| 4,125,245 | 11/1978 | Seidl | 249/33 |

FOREIGN PATENT DOCUMENTS

| | | | |
|---|---|---|---|
| 2250362 | 11/1972 | France | 249/217 |
| 209067 | 4/1966 | Sweden | 249/214 |

OTHER PUBLICATIONS

Catalog No. 500; Burke Concrete Construction Accessories; pp. 23–24.

*Primary Examiner*—Philip Anderson
*Attorney, Agent, or Firm*—Warren F. B. Lindsley

[57] ABSTRACT

A snaptie shoe assembly having a wedge engaging slot at each end in combination with a pair of snap-on shoes, one for each end of the snaptie, which shoes have a slotted rib with the rib walls and the slot configuration engaging when the rib is interposed between the walls of a form and the slot of the snaptie to form a snug fit.

4 Claims, 5 Drawing Figures

FLAT SHOE FORM TIE BRACKET FOR USE WITH CONCRETE FORMS

BACKGROUND OF THE INVENTION

This invention relates to form systems and is more particularly concerned with the ties and brackets utilized in maintaining a pair of laterally spaced form boards in a predetermined position relative to each other for the reception of concrete.

Poured concrete will generate pressure of approximately 160 pounds per square foot of depth, with the inevitable result that forms of any substantial size will require securing systems of tremendous strength. The most reliable of these involves an imbedded tie rod extending across the space between the forms, and which is submerged when the concrete is poured. This tie rod is threaded at both ends and is engaged by bolts traversing the form panels and secured to the reinforcing beams supporting the panels. The pressure against each of the opposite form systems is thus equalized. The cross-sectional dimensions of each of the tie assemblies in interrelated with the spacing of them so that the concrete pressure is effectively resisted.

Other known ties have their snapties equipped to receive special wedges which engage the outer surface of the walers or other stiffening members employed. These ties are usually equipped with spacing elements to hold the form panels apart before the concrete is poured and it is common practice further to provide the ties with reduced neck portions whereby the ends of the ties may be broken off beneath the surface of the concrete after the concrete has hardened.

Form systems are used primarily by commercial contractors and the overall cost of the procurement and use of the forms is therefore highly important. The initial cost of the form structure, having in mind the degree of re-use for which it is designed, must be considered along with the erection time of the form determined primarily by its tie system and also the stripping time required to disengage the tie system and remove the forms from the completed concrete wall. Accuracy of spacing is obviously important in order to preserve the dimensional continuity of the wall surface.

DESCRIPTION OF THE PRIOR ART

U.S. Pat. No. 4,125,245 discloses a top rail tie bracket for concrete forms eliminating the usual additional wooden rail required across the top of the form for bracing the wedging element of the top snaptie.

U.S. Pat. No. 2,168,990 discloses a form tie employing wedges which hold the form together by means of the tie rod and to a wrench which cooperates with the heads of the rods to break them off after their holding function has been fulfilled.

U.S. Pat. No. 3,977,647 discloses a bolted tie system employing wedges that transversely engage the bolts bridging the forms and bear on the flanges of marginal beams.

Other known prior art which show some of the features or characteristics of the claimed invention are the following U.S. Pat. Nos.

1,857,610;
2,190,700;
3,069,743;
3,199,828;
3,926,400;

3,315,937;
3,327,986;
3,734,453;
3,907,244.

Further, since prior to 1970, as evident from their Catalog No. 500, Burke Concrete Accessories, Inc. has been selling shoes for wire type snapties. These shoes and ties do not employ matingly engaging surfaces of the type disclosed and claimed herein for quick engaging and disengaging action. Further, the Burke structure does not effectively distribute the tensile stresses on the snaptie over the shoe structure. Accordingly, improvements over this type of structure are necessary.

SUMMARY OF THE INVENTION

In accordance with the invention claimed, a new and improved flat shoe form tie bracket is provided wherein the snaptie has a tapered configuration which matchingly engages with a slotted configuration of the snaptie shoe in a new and improved manner.

It is, therefore, one object of this invention to provide a new and improved snaptie shoe.

Another object of this invention is to provide a new and improved flat shoe form tie bracket in which the snaptie and shoe are provided with matingly engaging surfaces which quickly and easily engage and disengage in use.

A further object of this invention is to provide a new and improved snaptie shoe structure which is relatively simple in construction, inexpensive to manufacture and highly effective in backing up tensile stresses on a snaptie rod and is reusable.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
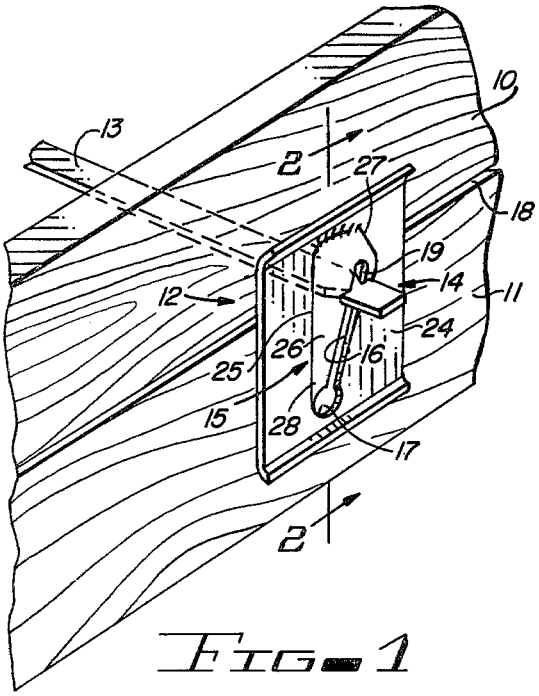
FIG. 1 is a perspective view of the top wall of one part of a form illustrating snaptie rod and flat wedging shoe and embodying the invention.

Referring more particularly to the drawing by characters of reference, FIG. 1 discloses a pair of panels 10 and 11 vertically arranged to form one wall of a concrete form held together and in proper spaced relationship with another similar wall (not shown) by a tie rod bracket assembly 12. These panels may be formed of wood or any other suitable material, the dimensional relationship being determined primarily by the depth of the pour and the resulting pressure of the poured concrete mass.

As used herein, a "snaptie" of the tie rod bracket assembly 12 is an elongated pin, rod or strip 13 having an enlarged head 14 on each end thereof which extends between two juxtapositioned walls of a concrete retaining form formed by one or more panels 10 and 11. These pins, rods or strips 13 may protrude through apertures provided in the panels of the walls of the form or between juxtapositioned panels of a wall, as shown in FIG. 1.

The "hairpin" or shoe 15, as used herein, is a wedging structure formed out of an elongated piece of material, such as cast iron, having a channel 16 cut through it along its longitudinal axis, which channel opens into an aperture 17 to receive the head 14 of the snaptie. The shoe 15 is in place on the snaptie when it is placed across the gap 18 between the two panels 10 and 11 of the wall and the enlarged head of the snaptie is inserted into the enlarged aperture 17 and the shoe channel 16. The shoe is then driven so that the outer shoulders or edges 19 of the channel 16 comes into contact with the head of the snaptie and since the shoe is wedge shaped in cross-section, the snaptie is urged outwardly from both sides of the walls of the form and is thus tightened as the shoe is driven between it and the panels 10 and 11 forming each of the spaced walls.

If panels 10 and 11 are in fact supporting boards for other walls of a form, they are known as a "waler" and it is intended that the claimed snaptie bracket be usable directly on panel walls of a form, as shown, or in cooperation with a waler which is used on the walls of a form.

Although FIG. 1 merely shows one snaptie with two panels of one wall of a concrete form, it is to be noted that any number of snapties and shoes and/or walers may be used in spaced relationship in a form configuration for holding the concrete mass in the form.

Further, the size of the snapties and shoes may be varied to suit the job on which they are used.

Referring to FIGS. 1–5, the snaptie shoe combinations are adapted to be secured to forms in a vertical, horizontal or any other desired position limited only by the spacing of the snapties. Further, it is obvious that the snapties extend between two spaced forms and the snaptie shoe combinations provide support for the forms as well as maintain their relative spacing. These snaptie shoe combinations are of a unitary construction with the snapties being slidably attached to the shoes so that each unit can be attached to a set of forms quickly by a single individual and detached with a minimum of effort.

The tie rod bracket assembly 12 essentially comprises a flat metal bar or strip 13, the ends or heads 14 of which are contoured to form flaps or tabs 20 and 21 cut out of the strip to extend laterally thereof to rest on the inside surfaces of the panels 10 and 11 and others like them. The center section 22 of the cutaway portion of the strip extends through the gap 18 between the vertically arranged panels.

The outer part of the heads 14 of the snaptie is provided with a particularly formed slotted configuration 23 one on each edge of the strip 13 which are contoured to lie around the surface of the peripheral edge 19 of channel 16 formed in shoe 15, as will be explained.

The wedge type shoe 15 constitutes the other principal part of the snaptie bracket and comprises a metal stamping generally forming a flat rectangular base configuration 24 having a medial region bowed forwardly at 25 to provide an elongated tapered rib 26 having a region 27 of high offset at one end thereof and a region 28 of low offset at its other end. The rib 26 is formed with the elongated slot or channel 16 which extends longitudinally of the rib. Aperture 17 is formed in the base configuration at the end of channel 16 which is low in offset, the aperture constituting an enlargement of the channel at such end.

Figure 3:
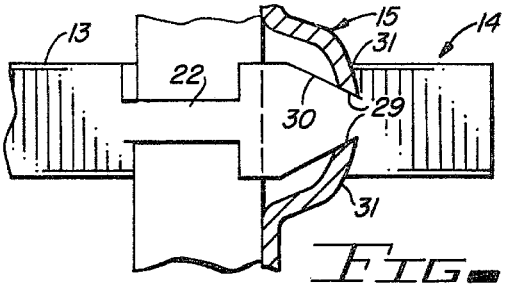
FIG. 3 is a top view partially in cross-section of the shoe in engagement with the snaptie rod.
Figure 4:
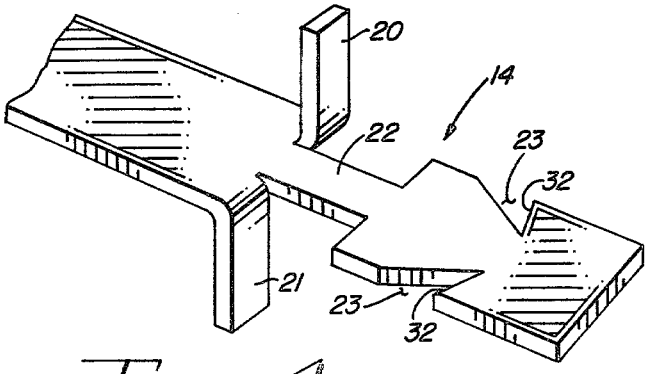
FIG. 4 is a partial perspective view of one end of the snaptie shown in FIGS. 1–3.
Figure 2:
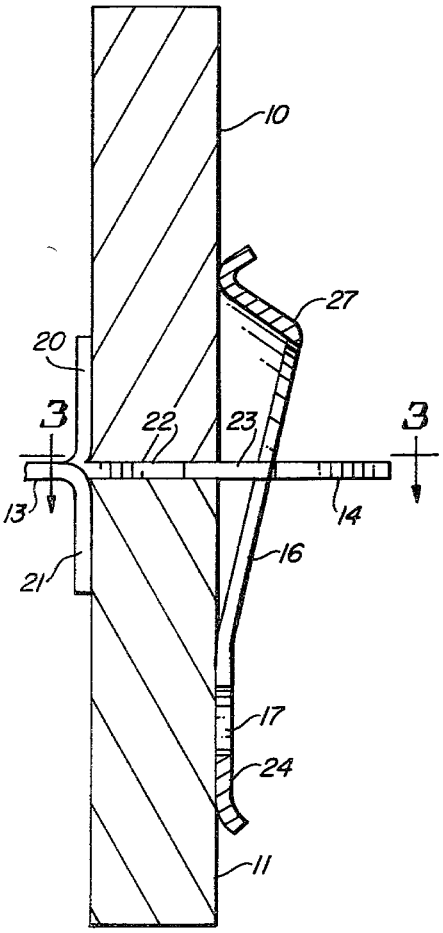
FIG. 2 is a cross-sectional view of FIG. 1 taken along the line 2—2.
Figure 5:
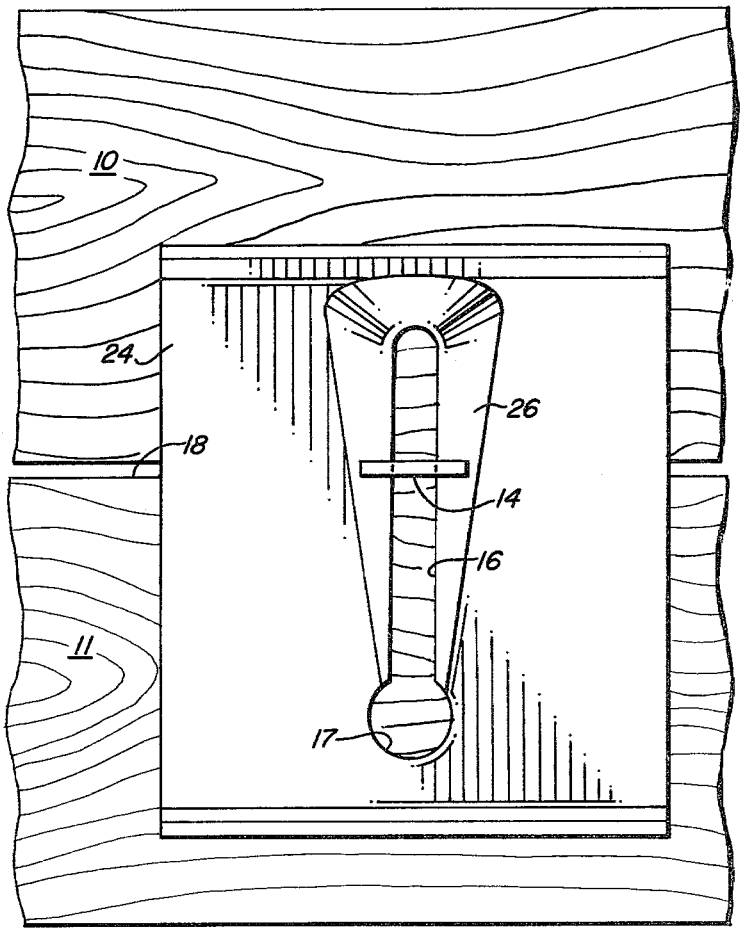
FIG. 5 is an enlarged front view of the snaptie, wedging shoe and form shown in FIG. 1.

In accordance with the invention claimed, the peripheral edges 19 of the channel 16 in rib 26 of shoe 15 is contoured to closely fit the edges 30 of the slot configuration 23 of head 14 of strip 13 of the snaptie, as more clearly shown in FIG. 3. Further, the outer periphery 31 of the rib 26 closely fits the edge 32 of the slot configuration 23. Thus, the angle of the outside surface 32 of the slot configuration 23 is substantially identical with the outside surface of the rib 26 so the shoe 15 and head 14 of the snaptie can slidably engage each other along the length of the shoe.

The force of the concrete in the form against panels 10 and 11 on each side of the form is transmitted through the strip 13, its edges 32 to the surfaces 29 of the channel 16 in the shoe 15 to form a strong connection of the shoe and snaptie.

With this form of connection, not only does a firm and relatively large surface contact exist between the snaptie and shoe, but the shoe may be easily engaged and disengaged without special tools and done so merely by the manual force of the laborer assembling the forms.

Although but one embodiment of the present invention has been illustrated and described, it will be apparent to those skilled in the art that various changes and modifications may be made therein without departing from the spirit of the invention or from the scope of the appended claims.

What is claimed is:

1. A snaptie shoe assembly for use in holding walls of a concrete form together comprising:

a snaptie formed of a flat strip of metal of rectangular cross-section having wedge engaging slots at each end thereof arranged on opposite edges of said strip at a common point along its edges, said snaptie comprising a pair of tabs formed from said strip to extend laterally thereof inwardly of said wedge engaging slots for bearing against the inside walls of vertically positioned panels of a wall of the form, the periphery of the edges of at least a part of said slots being conformed to engage and bear on the outer surface of a rib of a shoe, and a shoe for snugly fitting over said snaptie in the zone of said slots in wedging fashion, said shoe defining a rib having a narrow axial slot therein and presenting a region of high offset and a region of low offset, said shoe being provided with a flat base with one face engaging the outer surfaces of the panels of the wall of the form and with the rib thereof extending outwardly of its other flat surface, said rib being interposed between the walls of the form and said part of said slots of the snaptie with the outer surface of said rib around said slot snugly engaging said part of said slots.

2. The snaptie shoe assembly set forth in claim 1 wherein:

said slot of said rib is provided with an enlarged aperture at the lower end of said rib for receiving therethrough the end of said snaptie.

3. The snaptie shoe assembly set forth in claim 1 wherein:

said slots are of a triangular configuration.

4. The snaptie shoe assembly set forth in claim 1 wherein:

at least a part of the periphery of said slots substantially conform to the outside periphery of said rib.

* * * * *